United States Patent [19]

Ballreich et al.

[11] 4,142,466

[45] Mar. 6, 1979

[54] PROJECTILE WITH AT LEAST ONE PYROTECHNICAL CHARGE, ESPECIALLY A TRACER CHARGE

[75] Inventors: Kurt Ballreich; Ernst Jensen, both of Fürth; Alfred Ketterl, Neumarkt; Rudolf Stahlmann, Fürth, all of Fed. Rep. of Germany

[73] Assignee: Dynamit Nobel Aktiengesellschaft, Fed. Rep. of Germany

[21] Appl. No.: 816,136

[22] Filed: Jul. 15, 1977

[30] Foreign Application Priority Data

Jul. 31, 1976 [DE] Fed. Rep. of Germany ..... 2634518

[51] Int. Cl.[2] ..... F42B 11/16

[52] U.S. Cl. ..... 102/87; 102/60

[58] Field of Search ..... 102/6, 66, 60, 90, 87, 102/92.7, 92.4, 92.6

[56] References Cited

U.S. PATENT DOCUMENTS

| | | | |
|---|---|---|---|
| 3,494,285 | 2/1970 | Doris, Jr. et al. | 102/87 |
| 3,710,723 | 1/1973 | Muller | 102/87 |

FOREIGN PATENT DOCUMENTS

| | | | |
|---|---|---|---|
| 1293712 | 11/1960 | France | 102/87 |
| 1506498 | 12/1967 | France | 102/87 |

*Primary Examiner*—Harold J. Tudor

*Attorney, Agent, or Firm*—Craig & Antonelli

[57] ABSTRACT

A projectile with at least one longitudinally extending recess emanating from the rear end of the projectile and a rearwardly open sleeve having at least one pyrotechnical charge arranged therein. The sleeve is disposed within the recess and is arranged to be retained in the recess during and after the firing of the projectile. To enable retention of the sleeve, there is provided a pressure relief of propellant gases in the recess and/or abutments of the projectile and/or holding arrangements provided on the sleeve.

29 Claims, 7 Drawing Figures

Figure 1:
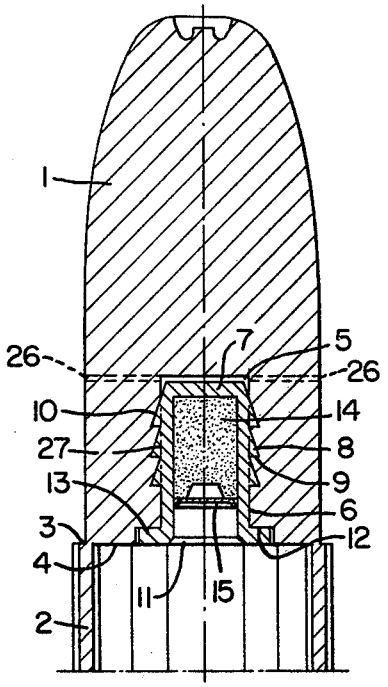

FIG. 4
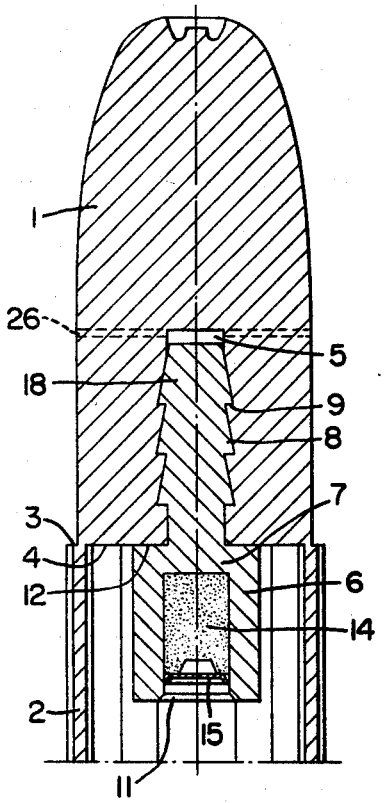
FIG. 5
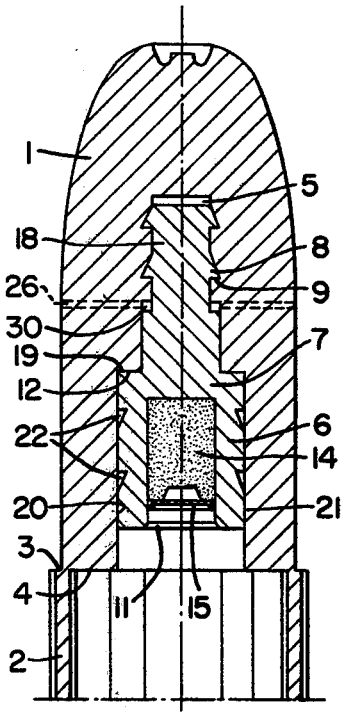
FIG. 6a
FIG. 6b
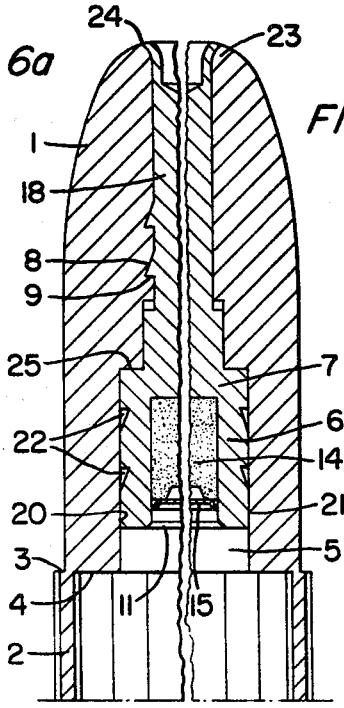

PROJECTILE WITH AT LEAST ONE PYROTECHNICAL CHARGE, ESPECIALLY A TRACER CHARGE

The present invention relates to a projectile of the type having at least one pyrotechnical charge, especially a tracer charge arranged in a rearwardly open sleeve, which sleeve is held in a longitudinally extending recess of the projectile.

It is known in metallic-cartridge or solid-jacket projectiles made of metal to press a tracer charge directly into a bore of the blind hole type emanating from the rear end of the projectile. It is furthermore conventional to press a tracer charge into a special casing and then insert or attach the latter in or to the bottom of the projectile. The tracer charge is ignited during firing by the propellant gases effective on the bottom of the projectile.

This conventional type of introduction and/or arrangement of tracer charges is unsatisfactory if the projectile is not made of an adequately firm material, such as, for example, brass or steel, but rather is made, for example, of soft iron, lead, or in the case of practice ammunition also of synthetic resins, such as polyethylene, polyvinyl chloride, polyamide, or wood. These materials either exhibit initially such small strength or become so yielding due to their low softening point upon exposure to hot propellant gases and/or during the deflagration of the tracer charge that the flawless functioning of the tracer charge is not ensured. When the tracer charge is pressed directly into the body of the projectile, it is possible with the use of these materials that, due to the required high amount of pressure employed, portions of the charge are uncontrollably pressed into the wall of the bore of the projectile and therefore irregularities can occur in manufacture and during the burning period. This danger exists, in particular, with the lightweight projectiles for training ammunition, made of a synthetic resin. However, even if the tracer charge is pressed into a metallic sleeve and the latter is then inserted in a blind hole of the projectile body, the problem is still unsolved in the case of such elastic and/or plastic projectile materials, inasmuch as normally it is impossible to achieve an adequately firm connection between the projectile and the sleeve containing the tracer charge. Consequently, this sleeve frequently falls out of the projectile shortly after the latter has exited from the barrel of the firearm, for example, within a range of about 80 meters and/or the sleeve is ejected toward the rear of the projectile due to the propellant gases which have entered into the gap between the sleeve and the wall of the blind bore. In other words, the perfect functioning of the tracer charge cannot be accomplished. Even if the rearward open end of the metallic sleeve, i.e. the mouth of the sleeve, is flanged into the body of the projectile, this disadvantage cannot be eliminated.

It is therefore an object of the present invention to provide a projectile of the type having at least one pyrotechnical charge arranged in a rearwardly open sleeve held in a longitudinal recess emanating from the rear of the projectile which overcomes the aforementioned disadvantages of such projectiles wherein the flawless functioning of the at least one pyrotechnical charge is reliably ensured even if the projectile is made of a material of a lower strength and/or with a relatively low softening point.

While the present invention is generally directed to projectiles for training purposes which are manufactured as lightweight projectiles of a synthetic resin, wood, or the like, the present invention also has applicability to projectiles for live ammunition, which are made of lead, soft iron, or the like. The at least one pyrotechnical charge is preferably a tracer charge. However, this charge can also be a firecracker charge, a smoke charge, an incendiary charge, or the like. Also, combinations of various charges with one another are possible, and furthermore at least one delay charge on a pyrotechnical basis can also be additionally provided.

In accordance with the present invention there is provided a projectile with at least one pyrotechnical charge, especially a tracer flare charge, arranged in a rearwardly open sleeve, this sleeve, in turn, being held in a longitudinal recess emanating from the rear end of the projectile, with the recess one of being connected to the jacket surface and/or the forward end of the projectile, the sleeve being supported in the forward direction, contacting an abutment surface of the projectile and/or the sleeve being provided at a spacing from its rear end, at least one holding element, making it possible to establish a form-fitting connection with the projectile.

According to a feature of the present invention, the longitudinal recess for the mounting of the sleeve receiving the pyrotechnical charge is preferably arranged centrally, i.e. lying in the longitudinal axis of the projectile. However, a location outside of the longitudinal axis is likewise possible, insofar as, for example, two or more recesses, symmetrically distributed over the bottom of the projectile, are provided with corresponding charges. The recess, fashioned for example as a central blind hole, can be in communication with the outer jacket surface of the projectile with its front end via several bores uniformly distributed over its circumference and extending radially or also inclined obliquely to the longitudinal axis. By way of these lateral bores, the propellant gases which may have entered into the recess by way of the gap between the sleeve and the body of the projectile can exit from the projectile laterally after the latter has left the barrel of the firearm, whereby advantageously a pressure relief of the sleeve is obtained for the pyrotechnical charge and thus the rearward ejection of the sleeve is avoided. However, preferably, the provision is made, in place of lateral discharge openings, to fashion the recess to be continuous, i.e. extending from the rearward end face of the projectile up to the forward end face and/or up to the tip of the projectile. To prevent, in this connection, the sleeve from being driven through the recess of the projectile under the pressure effect of the propellant gases during firing, the sleeve has a shoulder, flange, or the like of an appropriate size, enabling the sleeve to rest toward the front against the body of the projectile and which prevents the "shooting through" of the sleeve. Such an additional abutment also proves advantageous in the case of lateral discharge openings, unless the forward end face of the recess is to serve as such abutment. The abutment surface or surfaces are preferably oriented in the radial direction, but they can also optionally be arranged inclined toward the longitudinal axis of the projectile.

In addition to or in place of the pressure relief of the sleeve by the lateral and/or forwardly directed discharge of any propellant gases which may have penetrated into the recess, a further feature of the present invention provides equipping the sleeve with at least one holding element arranged at a spacing from the mouth of the sleeve, this holding element locking the sleeve together with the projectile form-fittingly, so that the sleeve cannot be ejected toward the rear under the rearwardly directed pressure of any propellant gases which may have entered the recess, once the projectile has been fired from the barrel. This form-fitting interlocking action is preferably used in place of the intentional pressure relief. The arrangement of the at least one holding element at a spacing from the mouth of the sleeve makes it possible, as contrasted to the aforementioned, simple flanging of the sleeve mouth into the wall of the recess, to effect advantageously a secure anchoring of the sleeve within the projectile. The at least one holding element can be constructed, for example, in the manner of a bayonet catch in the form of several cam members uniformly distributed over the periphery of the sleeve, the cam members engaging corresponding grooves of the recess wall. Basically likewise possible is a connection with the use of symmetrically disposed radial pins inserted into the projectile from the outside and partially penetrating the wall of the sleeve.

In accordance with another feature of the present invention wherein the longitudinal recess is a continuous axial recess of the projectile and the sleeve is optionally provided with a stem-shaped forward extension which is outwardly expanded in the zone of the forward end of the recess which extends over the entire length of the projectile so that the body of the projectile is held between the sleeve portion contacting the abutment surface and the forward expansion of the sleeve. Thus, the provision is made to expand the sleeve and/or its optionally provided forward extension at the tip of the projectile and, during this step, pressing or flanging the same against the tip of the projectile, so that the sleeve and the jacket-like body of the projectile surrounding the sleeve are reliably joined together by the rearward abutment surface and the forward flanging of the sleeve.

In order to maintain the amount of propellant gas, which may have entered the recess, at a minimum, especially if no intentional pressure relief of the sleeve is provided, another feature of the present invention provides that the sleeve is fashioned with an additional sealing surface, by means of which the sleeve is pressed, under the pressure of the propellant gases, against a corresponding counter surface of the projectile. The sealing surface should, if possible, always be fashioned as a continuous annular surface, whereas, for example, it may be sufficient for contacting an abutment surface of the projectile to be formed from several supporting cam portions arranged so that they are distributed along the circumference. If the sealing surface is fashioned at the rearward end of the sleeve, i.e. at the mouth of the sleeve, as a preferably radially arranged annular flange, this feature additionally enhances the dimensional strength of the sleeve to a particularly great extent.

In accordance with another feature of the present invention, at least two annular holding elements are provided making it possible, as compared to a single holding element or optionally several localized holding elements distributed over the circumference, to reduce on the one hand the specific load per unit area of the projectile material and on the other hand to provide an improved seal of the gap between the sleeve and the body of the projectile. Preferably, the sleeve is equipped, in this case, with annular webs, annular bulges, annular ribs, or the like, and the recess has corresponding annular grooves, annular notches, annular furrows, or the like. However, it is conversely also possible to provide the sleeve with the indentations and the recess with the corresponding radial projections. Insofar as the material of the projectile is sufficiently elastic, such as a thermoplastic synthetic resin, for example, the sleeve can be pressed, during assembly, into the recess in the manner of a snap connection until the form-fitting elements have been locked together. In the case of other projectile materials, such as soft iron or lead, for example, the body of the projectile can be pressed against the sleeve, for instance, by means of a calibrating step following the step of insertion of the sleeve, and thereby the body of the projectile can be form-fittingly joined to the sleeve. Preferably, the annular projections of the sleeve have a sawtooth-like cross section, wherein the flank of the projections facing the rearward end of the sleeve is suitably oriented in the radial direction.

The construction of the sleeve wherein the sleeve is extended in the forward direction past its bottom, the extension, preferably fashioned as a stem-like extension, is provided with at least one holding element, has the advantage that the arrangement and dimensioning of the at least one holding element is not limited to the zone between the mouth and bottom of the sleeve proper. If the at least one holding element is arranged exclusively in the zone of the extension, i.e. in front of the bottom of the sleeve, the sleeve which contains the pyrotechnical charge can be fashioned with an outer jacket surface which is free of projections and/or indentations. This is advantageous for the radial, outward support of the sleeve during the impression of the at least one pyrotechnical charge into the sleeve, which step is executed before the sleeve is inserted in the projectile.

An additional reduction of the propellant gases possibly penetrating into the recess can be attained by providing that the sleeve contacts with its outer jacket surface the wall of the recess, and the jacket surface and/or the wall has one or more annular notches, cutouts, furrows, or the like. Thus, there results a type of labyrinth seal of the point where the sleeve contacts the wall of the recess, this seal being located between the two parts. For this purpose, the sleeve is advantageously provided with corresponding annular indentations.

The sleeve for the at least one pyrotechnical charge is preferably fashioned to be so firm and dimensionally stable that, during the insertion of the sleeve in the projectile, the impressed charge is not loosened, cracked, or the like, so that a repeated impressing of the charge is avoided. During such a repeated impressing step, on account of the very high pressure force required for this purpose, it is possible that the projectile is deformed by squeezing, unless an outer radial support is provided for the projectile during this repeated impressing step, which can in certain cases be very expensive. In the case of large-caliber projectiles, and projectiles made of soft iron or the like, it is generally possible to make the sleeve of steel. In the case of more lightweight projectiles, i.e. especially training ammunition of a smaller caliber consisting of a synthetic resin, it is normally necessary, however, for weight reasons to produce the sleeve from correspondingly lightweight materials, such as, for example, an aluminum alloy or other light metals. In this case it can be advantageous to attain the desired strength and dimensional stability by utilizing an additional reinforcing tube so that the pyrotechnical charge or charges are not impressed directly into the sleeve, but rather are introduced into the special reinforcing tube which, in turn, is forced with a press-fit into the sleeve and firmly anchored therein, for example, by riveting. The smooth reinforcing tube can be relatively thin-walled, and made, for example, of steel.

The sleeve according to this invention offers the additional advantage, particularly when fashioned with a forward extension, that it is possible, by means of the weight of the sleeve and its spatial arrangement within the body of the projectile, to adjust the position of the center of gravity of the projectile in correspondence with the external ballistics required in an individual case.

These and further objects, features and advantages of the present invention will become more obvious from the following description when taken in connection with the accompanying drawings which show, for purposes of illustration only, several embodiments in accordance with the present invention; and wherein FIGS. 1 through 5 show, respectively, longitudinal sectional views of different embodiments of a tracer projectile in accordance with the present invention; and FIGS. *6a* and *6b* show, respectively, half-sectional views of different embodiments in accordance with the present invention.

Referring now to the drawings wherein like reference numerals designate like parts throughout the several views, there is shown in FIG. 1, as well as in the other figures, a projectile 1 manufactured integrally with a cartridge case 2, shown only in the foward section and formed of polyethylene, for example. During the firing, the projectile is conventionally separated at a predetermined rupturing zone 3. It is, of course, also possible to manufacture the projectile 1 separately from the cartridge case 2 and then to insert the projectile in the case and hold same therein in a conventional manner. In this arrangement, the materials for the two components are chosen in correspondence with the respective requirements.

A sleeve 6, for example, made from an aluminum alloy, including a bottom portion 7, is pressed into a blind-hole type recess 5 emanating from the rear end 4 of the projectile 1 and is joined form-fittingly with the projectile 1 via three annular holding elements 8. The holding elements 8 have a sawtooth-like cross section wherein the rearward flank 9 extends in radial planes. The recess 5 is provided with annular grooves 10 corresponding with the holding elements 8. At the rearward open end 11 of the sleeve 6, i.e. the mouth of the sleeve, a sealing surface 12 is provided by forming the sleeve 6 with a radial annular flange or collar 13. Due to the elastic and/or plastic material of the projectile, a gas-tight, firm connection is obtained via the annular collar 13 between the projectile 1 and the sleeve 6. A pyrotechnical charge 14 which is pressed into the sleeve 6, in this case a tracing flare charge, is covered with the foil 15 made, for example, of paper, aluminum, or a synthetic resin. The projectile 1 may also be provided for pressure relief with at least two radial bores 26, shown in dashed line, connecting the forward portion recess 5 with the jacket surface of the projectile. The bores are symmetrically distributed in consideration of symmetrical stressing of the projectile. Alternatively, the bores may be arranged in the region of the sleeve 6 whereby the sleeve 6 and the recess 5 would be provided with a smooth cylindrical outer surface and smooth internal wall, respectively, as illustrated in dot-dash lines 27.

Figure 2:
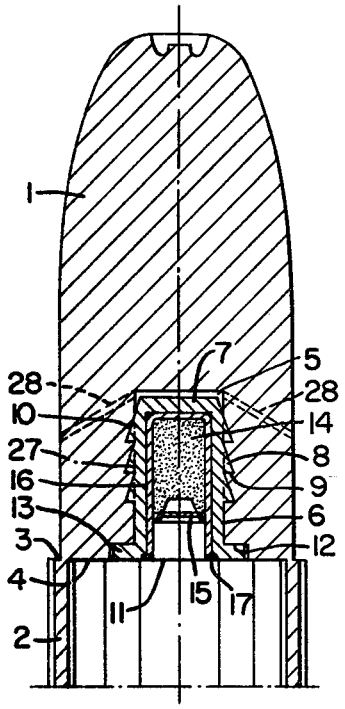

In FIG. 2, an additional reinforcing tube 16 of steel, for example, is inserted in the sleeve 6. This tube is firmly anchored within the sleeve 6 by means of an annular bracing device 17. Also, at least two inclined bores 28 may connect the forward end of the recess 5 with the jacket surface of the projectile. The angle of inclination is related to the specific requirements of the projectile and are advantageously inclined in the rearward direction so that propellant gases flowing from such bores will effect a supplementary acceleration of the projectile. Alternatively, the bores 28 may be arranged in the region of the sleeve 6 with the sleeve and recess modified as shown in dot-dash lines 27. Otherwise, the arrangement corresponds to that of FIG. 1.

Figure 3:
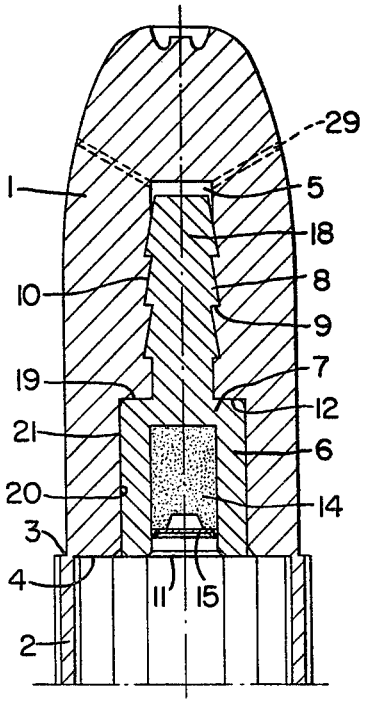

In the projectile shown in FIG. 3, the sleeve 6 is provided with an extension 18 extending in the forward direction beyond the sleeve bottom portion 7 with the extension in this case being fashioned as a stem having an outer diameter which is smaller than that of the sleeve portion containing the pyrotechnical charge 14. The holding elements 8 are provided exclusively in the zone of the extension 18. The shoulder at the transition from the bottom portion 7 to the extension 18 acts as the sealing surface 12, this shoulder being supported in the forward direction on the counter surface 19 of the recess 5. The sleeve 6 is pressed into the recess 5 with a press-fit, joined form-fittingly with the projectile 1 by way of the holding elements 8, and contacts with its outer jacket surface 20 the wall 21 of the recess 5. In this embodiment, inclined bores 29 are provided which are inclined in the forward direction to effect a supplementary braking of the projectile.

According to FIG. 4, it is not the entire sleeve 6 which is arranged within the recess 5, but merely its extension 18. The portion of the sleeve 6 containing the pyrotechnical charge 14 is disposed behind the projectile 1. In this arrangement, the sleeve 6 is supported in the forward direction on the bottom part 4 of the projectile 1 by way of its annular sealing surface 12. This arrangement proves advantageous, inter alia, depending on the heat evolution during the burning of the pyrotechnical charge 14, if the material of the projectile 1 has a relatively low softening point. Also, radial bores 26 are provided as in FIG. 1.

In the embodiment shown in FIG. 5, the sleeve 6 is provided, between its rear end 11 and its sealing surface 12, on its outer jacket surface 20, with two continuous grooves 22 tapped into the sleeve which, together with the contacting wall 21 of the recess 5, result in an additional labyrinth seal. Depending on the elasticity of the material of projectile 1, this material can also enter the grooves 22 to a greater or lesser extent during the course of time. Also, radial bores 26 are provided connecting a portion 30 of the recess 5 with the outer jacket surface of the projectile.

In the projectile 1 illustrated in FIGS. *6a* and *6b*, the axial recess 5 is formed as a continuous recess, i.e. it extends up to the front end 23 of the projectile 1 so that in this manner the recess is connected with the outer jacket surface. The extension 18 of the sleeve 6 has its forward rim 24 flanged outwardly against the body of the projectile. In the forward direction, the sleeve 6 is supported on an abutment 25 of the recess 5. Instead, it is also possible optionally to provide the sleeve 6 at its rear end 11 with an annular collar in a manner similar to the illustration of FIGS. 1 or 2, the annular collar contacting the bottom 4 of the projectile 1. The projectile 1 and the sleeve 6 are firmly connected together by the abutment 25 and the flanged-over rim 24. The embodiment shown in FIG. 6*a* shows, as contrasted to FIG. 6*b*, also two additional, annular holding elements 8 in the zone of the extension 18. Although the annular gap between the recess 5 and the sleeve 6 is very small due to the forced insertion of the sleeve 6 in the projectile 1, it is still possible for propellant gases to enter into this gap during firing. These propellant gases can then escape by way of the forwardly open recess 5 so that, according to FIG. 6*b*, additional holding elements can, in certain cases, be omitted and yet the flawless functioning of the at least one pyrotechnical charge is ensured.

While we have shown and described several embodiments in accordance with the present invention, it is understood that the same is not limited thereto but is suceptible of numerous changes and modifications as known to those skilled in the art and we therefore do not wish to be limited to the details shown and described herein but intend to cover all such changes and modifications as are encompassed by the scope of the appended claims.

What is claimed is:

1. A projectile having at least one longitudinally extending recess means emanating from the rear end of the projectile, the projectile being formed of a material of one of low strength and low softening point, a rearwardly open sleeve means having at least one pyrotechnical charge arranged therein, the sleeve means being at least partially disposed within the recess means, the sleeve means including a sleeve member having a predetermined external diameter and a stem-shaped forward extension portion having an external diameter smaller than the external diameter of the sleeve member, and means for enabling retention of the sleeve means within the recess means during and after the firing of the projectile, the retention enabling means including an abutment surface of the projectile, a portion of the sleeve member contacting the abutment surface of the projectile for supporting the sleeve means in the forward direction and effecting a seal thereat, the retention enabling means further including at least one of pressure relief means for relieving pressure build-up resulting from propellant gases in the recess means and holding means in the stem-shaped forward extension portion establishing a form-fitting connection with the projectile.

2. A projectile according to claim 1, wherein the projectile is formed of one of soft iron, lead, wood, and a synthetic resinous material.

3. A projectile according to claim 2, wherein the at least one pyrotechnical charge is a tracer charge.

4. A projectile according to claim 1, wherein the pressure relief means includes means for communicating at least a portion of the recess means with an outer surface of the projectile.

5. A projectile according to claim 4, wherein the communicating means includes bore means communicating the recess means with an outer surface of the projectile.

6. A projectile according to claim 5, wherein the bore means includes at least two bores radially extending from the recess means to the outer surface of the projectile.

7. A projectile according to claim 5, wherein the bore means includes at least two bores inclined with respect to the longitudinal axis of the projectile.

8. The projectile according to claim 7, wherein the at least two bores are inclined in the forward direction.

9. A projectile according to claim 7, wherein the at least two bores are inclined in the rearward direction.

10. A projectile according to claim 1, wherein the recess means is a continuous recess extending from the rear and to the forward end of the projectile and communicating with an outer surface of the projectile.

11. A projectile according to claim 11, wherein the stem-shaped forward extension portion is outwardly expanded in the zone of the forward end of the continuous recess which extends over the entire length of the projectile.

12. A projectile according to claim 11, wherein at least a portion of the projectile is held between the portion of the sleeve member contacting the abutment surface and the forward expanded portion of the sleeve means.

13. A projectile according to claim 1, wherein the holding means includes at least one of at least two annular projections and indentations arranged for engagement with at least one of corresponding annular indentations and projections of the projectile.

14. A projectile according to claim 1, wherein the sleeve means has an outer jacket surface and the recess means includes a wall portion, the outer jacket surface of the sleeve member contacting the wall portion of the recess means, and one of the outer jacket surface and the wall portion being provided with at least one annular depression.

15. A projectile according to claim 1, further comprising reinforcing tube means being disposed in the sleeve means.

16. A projectile according to claim 1, wherein the holding means and pressure relief means are provided and the pressure relief means includes means for communicating at least a portion of the recess means with an outer surface of the projectile.

17. A projectile according to claim 16, wherein the communicating means includes bore means communicating the recess means with an outer surface of the projectile.

18. A projectile according to claim 17, wherein the bore means includes at least two bores radially extending from the recess means to the outer surface of the projectile.

19. A projectile according to claim 18, further comprising reinforcing tube means being disposed in the sleeve means.

20. A projectile according to claim 1, wherein the recess means is a continuous recess extending from the rear and to the forward end of the projectile and communicating with an outer surface of the projectile.

21. A projectile according to claim 20, wherein the stem-shaped forward extension portion is outwardly expanded in the zone of the forward end of the continuous recess which extends over the entire length of the projectile.

22. A projectile according to claim 21, wherein at least a portion of the projectile is held between the portion of the sleeve member contacting the abutment surface and the forward expanded portion of the sleeve means.

23. A projectile according to claim 22, wherein the projectile is formed of one of soft iron, lead, wood, and a synthetic resinous material.

24. A projectile according to claim 23, further comprising reinforcing tube means disposed in the sleeve means.

25. A projectile according to claim 1, wherein the external diameter of the stem-shaped extension portion is substantially smaller than the external diameter of the sleeve member.

26. A projectile according to claim 1, wherein the weight of the sleeve means and the spatial arrangement thereof including the stem-shaped forward extension portion within the projectile provide for adjustment of the position of the center of gravity of the projectile in correspondence with predetermined external ballistics for the projectile.

27. A projectile according to claim 1, wherein the holding means includes at least one annular element on the stem-shaped portion having a saw-tooth-like cross-section with the rearward flank thereof extending radially outwardly for establishing a form-fitting connection with the projectile.

28. A projectile according to claim 27, wherein the pressure relief means are provided with the holding means.

29. A projectile according to claim 1, wherein the sleeve member is disposed within the recess means and forms a labyrinth seal with a wall of the recess means.

* * * * *